US011117738B2

(12) United States Patent
White

(10) Patent No.: US 11,117,738 B2
(45) Date of Patent: Sep. 14, 2021

(54) DRINKWARE FLAVOR APPLICATOR

(71) Applicant: Richard White, San Antonio, TX (US)

(72) Inventor: Richard White, San Antonio, TX (US)

( * ) Notice: Subject to any disclaimer, the term of this patent is extended or adjusted under 35 U.S.C. 154(b) by 184 days.

(21) Appl. No.: 16/429,380

(22) Filed: Jun. 3, 2019

(65) Prior Publication Data

US 2019/0367259 A1 Dec. 5, 2019

Related U.S. Application Data

(60) Provisional application No. 62/679,103, filed on Jun. 1, 2018.

(51) Int. Cl.
*B65D 85/804* (2006.01)
*A47G 19/22* (2006.01)

(52) U.S. Cl.
CPC ..... *B65D 85/8043* (2013.01); *A47G 19/22* (2013.01)

(58) Field of Classification Search
CPC . B65D 85/8043; B65D 81/3205; A47G 19/22
See application file for complete search history.

(56) References Cited

U.S. PATENT DOCUMENTS

| | | | | |
|---|---|---|---|---|
| 3,450,096 | A * | 6/1969 | Lancette | A47G 19/22 118/16 |
| 5,246,142 | A | 9/1993 | DiPalma et al. | |
| 5,567,461 | A * | 10/1996 | Lehrer | A23D 9/06 210/501 |
| 8,522,968 | B2 | 9/2013 | Middleman et al. | |
| 9,649,654 | B2 | 5/2017 | Goodrum | |
| 2001/0045374 | A1 | 11/2001 | Selker | |
| 2004/0206302 | A1 * | 10/2004 | Propp | A47G 19/22 118/13 |
| 2005/0214418 | A1 | 9/2005 | Radow | |
| 2009/0211458 | A1 * | 8/2009 | Denisart | B65D 85/8043 99/300 |
| 2010/0116699 | A1 | 5/2010 | Sorenson | |
| 2014/0161937 | A1 * | 6/2014 | Rondelli | B65D 85/8043 426/80 |

OTHER PUBLICATIONS http://www.thebrewskey.com/engineering.
https://www.barproducts.com/bottle-top-salt-rimmer-drink-topper.

* cited by examiner

*Primary Examiner* — Viren A Thakur
(74) *Attorney, Agent, or Firm* — Brandon T. Cook; Gunn, Lee & Cave, P.C.

(57) ABSTRACT

A drinkware flavor applicator comprising a housing with an opening, an internal reservoir, a stop plate, a filter and a seal. Flavoring is stored in the reservoir and/or in the filter. The flavor applicator is placed over the drinking end of a bottle and flavoring stored in the reservoir and/or filter is transferred to the bottle.

4 Claims, 3 Drawing Sheets

DRINKWARE FLAVOR APPLICATOR

CROSS-REFERENCES TO RELATED APPLICATIONS

This application claims the benefit of provisional patent application No. 62/679,103 filed Jun. 1, 2018.

STATEMENT REGARDING FEDERALLY SPONSORED RESEARCH OR DEVELOPMENT

Not applicable.

BACKGROUND OF THE INVENTION

1. Field of the Invention

It is often desirable for a consumer to apply flavoring to the exterior of drinkware and/or to the liquid content of the drinkware. For example, it is common for beer drinkers and/or bar tenders to apply salt and lime to the exterior of the beer bottle or glass. However, the existing products and methods for applying flavoring to the exterior of drinkware are insufficient and messy. The present invention is a device and method for efficiently applying flavoring to the exterior of drinkware.

There are existing products designed to increase the efficiency of applying flavoring to drinkware exterior. For example, U.S. Pat. No. 9,649,654 B2 discloses a product for applying salt to the neck of a beer bottle.

SUMMARY OF THE INVENTION

The present invention is a drinkware flavor applicator comprising a housing, internal reservoir, stop plate, filter, flavoring, an opening in the housing, and a seal. The opening is generally circular with a diameter slightly larger than the diameter of the desired drinkware. The drinking end of the drinkware is inserted into the opening of the flavor applicator. Once inserted into the flavor applicator, the drinking end of the drinkware is introduced to the flavoring stored in the housing. At least some of the flavoring transfers from the flavor applicator to the drinkware.

DETAILED DESCRIPTION

Figure 1:
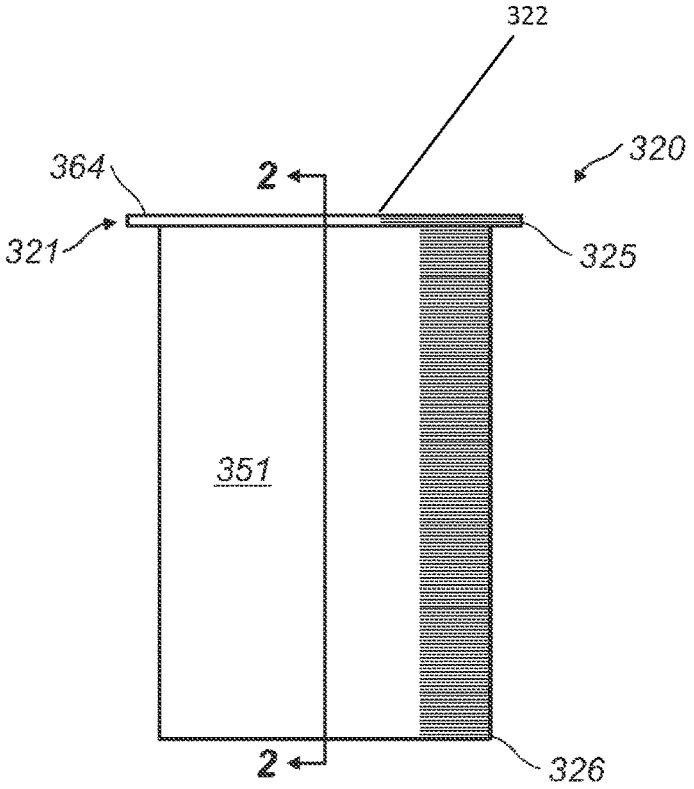
FIG. 1 is a side view of a first embodiment of the flavor applicator.
Figure 2:
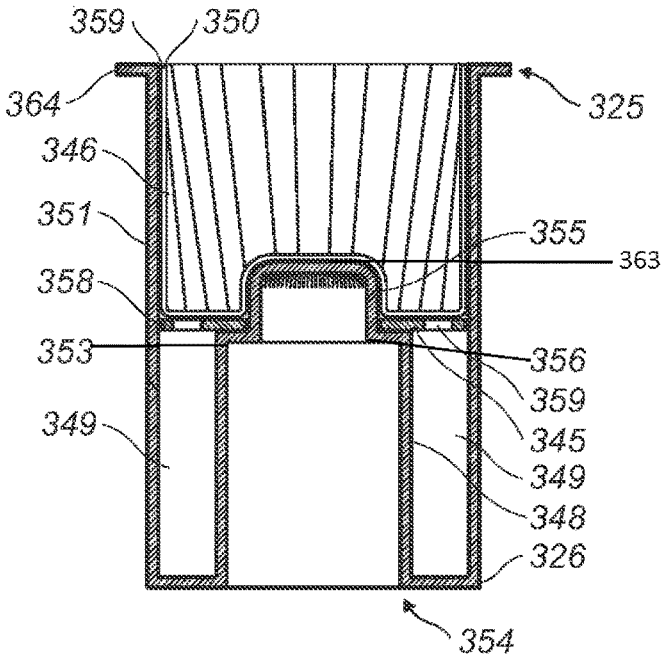
FIG. 2 is a cross section of FIG. 1 taken along line 2-2.
Figure 3:
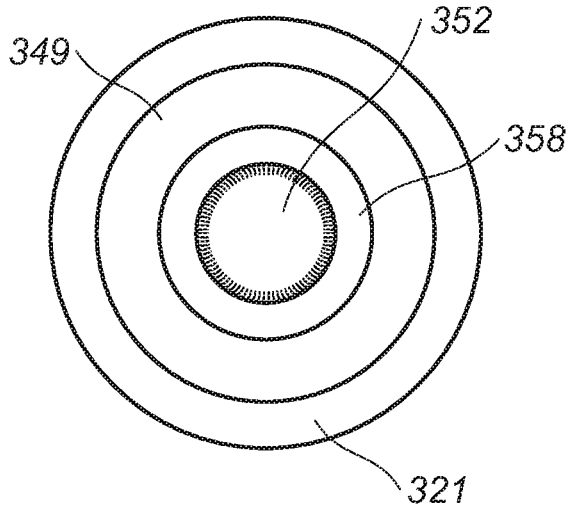
FIG. 3 is a top view of the first embodiment without the stop plate or filter inserted.
Figure 4:
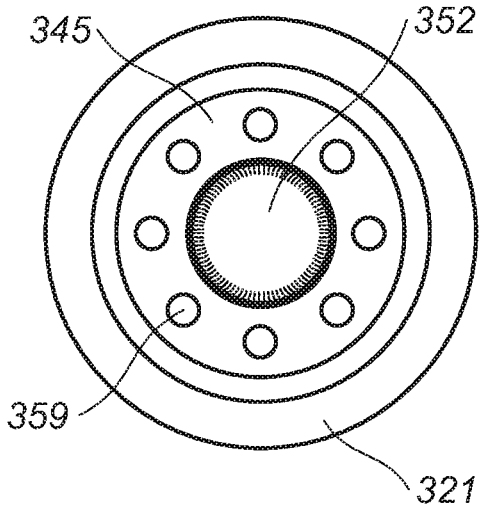
FIG. 4 is a top view of the first embodiment with the stop plate inserted and without the filter inserted.
Figure 5:
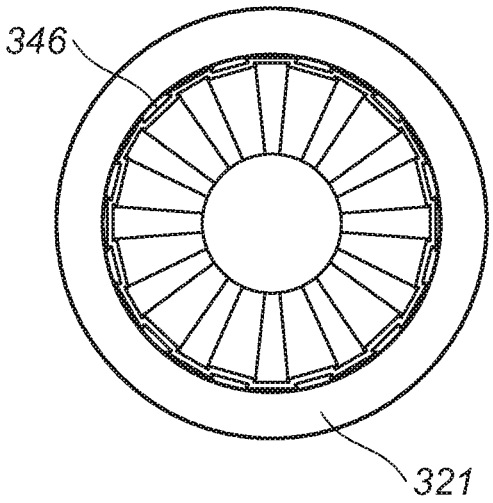
FIG. 5 is a top view of the first embodiment with the stop plate and filter inserted.
Figure 6:
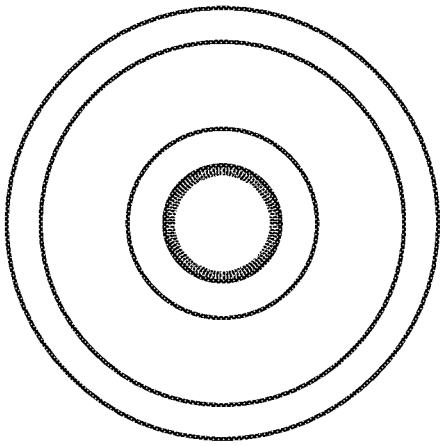
FIG. 6 is a bottom view of the first embodiment of the flavor applicator.
Figure 7:
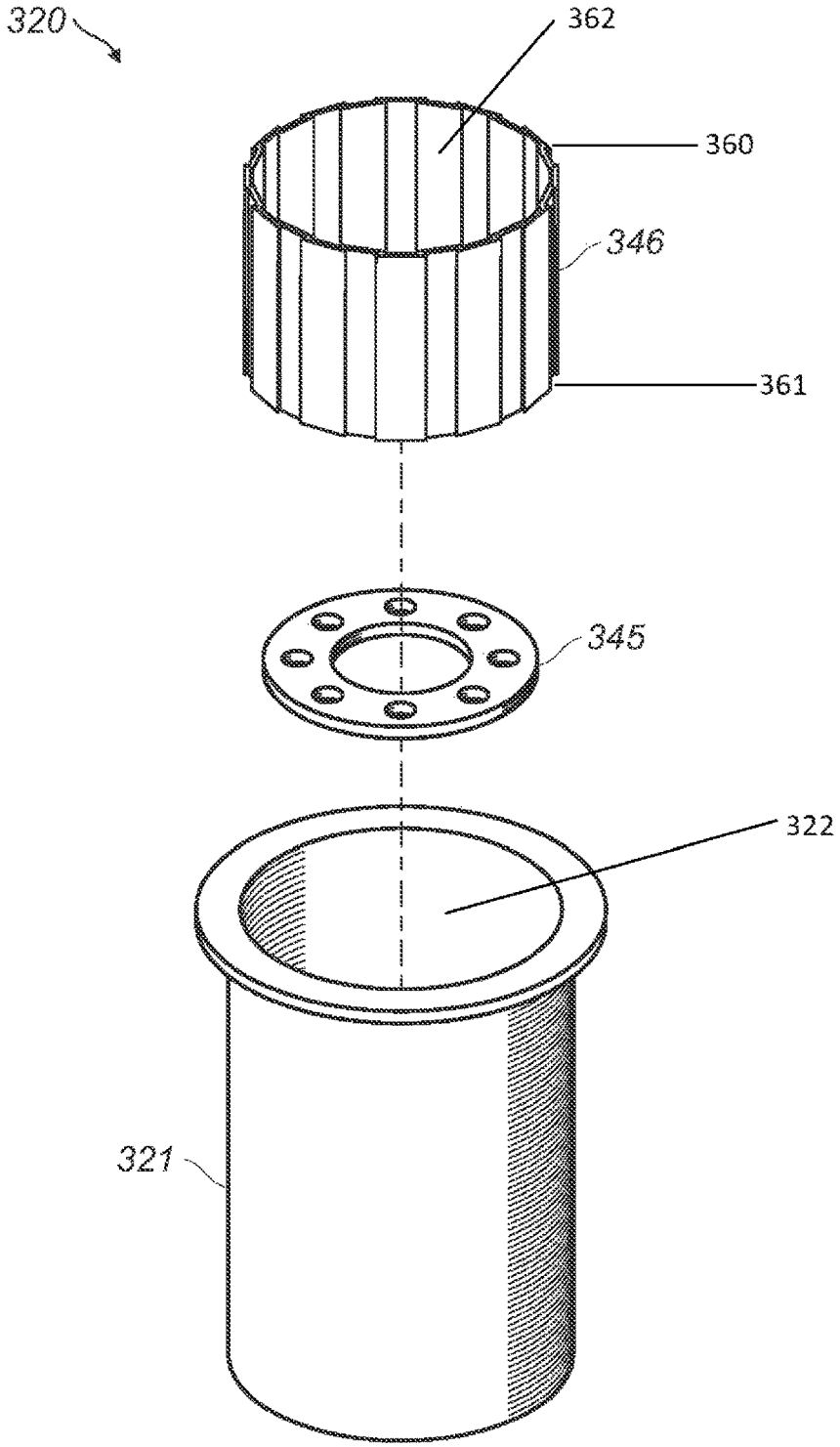
FIG. 7 is an exploded view of the first embodiment of the flavor applicator.

The structure of a first embodiment 320 of the flavor applicator is described with reference to FIGS. 1-7. The flavor applicator 320 comprises a housing 321, a stop plate 345, a filter 346, and a seal 334 (not shown).

The housing 321 is an elongated semi-hollow cylinder with a first end 325, a second end 326, an interior wall 350, an exterior wall 351, and an upper lip 364 integral the first end 325. The housing 321 has a circular opening 322 co-planar with the first end 325. The housing 321 has a first pillar 348 integral the second end 326 of the housing and extending towards the first end 325. The first pillar 348 is generally cylindrical prism shaped with a first end 353, a second end 354, and an outer diameter smaller than the inner diameter of the housing 321. The second end 354 of the first pillar 348 is integral the second end 326 of the housing 321. The smaller diameter of the first pillar 348 relative the interior diameter of the housing 321 creates a first reservoir 349 between to the interior wall 350 of the housing 321 and the first pillar 348.

The housing 321 further comprises a second pillar 352 having a first end 355 and a second end 356. The second end 356 of the second pillar 352 is integral the first end 353 of the first pillar 348. The exterior diameter of the second pillar 352 is smaller than the exterior diameter of the first pillar 348. The difference in diameter between the first pillar 348 and the second pillar 352 creates an annular shelf 358 between the first end 353 of the first pillar 348 and the second end 356 of the second pillar 352. The combined length of the first pillar 348 and second pillar 352 is less than the length of the housing 321, leaving a void cylindrical volume between the first end 355 of the second pillar 352 and the opening 322 of the housing 321. The housing 321, first pillar 348, and second pillar 352 have the same central axis.

The stop plate 345 is a flat annular prism with an exterior diameter slightly smaller than the interior diameter of the housing 321. The interior diameter of the stop plate 345 is slightly larger than the exterior diameter of the second pillar 352, and smaller than the exterior diameter of the first pillar 348. When inserted, the stop plate 345 rests on the annular shelf 358. The stop plate 345 has circular apertures 359 spaced evenly around the stop plate 345.

The filter 346 has a first end 360, a second end 361, and an opening 362 coplanar with the first end 360. The filter is generally cylindrical in shape, with an exterior diameter slightly smaller than the interior diameter of the housing 321. The second end 361 of the filter 346 has a cylindrical indention 363. The interior diameter of the indention 363 is slightly larger than the exterior diameter of the second pillar 352.

The interior diameters of the housing 321, housing opening 322, and filter 346 are larger than the exterior diameter of a standard beverage bottle.

The set-up of the flavor applicator 320 is described with reference to FIGS. 1-7. Flavor substance such as lime juice or lime flavoring is inserted into the reservoir 349 of the flavor applicator 320. The stop plate 345 is inserted into the flavor applicator 320 and sits on top of the shelf 358. The stop plate 345 is held into place by either a friction fit with the interior wall 350 of the housing 321, a friction fit with the second pillar 352, and/or by glue or similar adhesive between the stop plate 345 and the shelf 358. In some embodiments, the stop plate may not be affixed to the housing 321 and instead be loosely placed within the housing 321. The filter 346 is inserted into the housing 321, covering the stop plate 345 and second pillar 352. The indention 363 portion of the second end 361 of the filter 346 surrounds the upper portion of the second pillar 352 and may form a friction fit thereto. The non-indented portion of the second end 361 of the filter 346 sits on the stop plate 345. The filter 346 is held into place by a friction fit with the second pillar 352, friction fit with the interior wall 350 of the housing 321, and/or glue or some other suitable adhesive. Additional flavoring, such as salt, is added to the cavity formed between the second end of the filter 361 and the filter opening 362. A seal 334 (not shown) can be placed onto the lip 364 of the housing 321, sealing the contents of the housing 321 therein. In other embodiments, the seal 334 is placed directly onto the housing 321.

The function of the flavor applicator 320 is described with reference to FIGS. 1-7. The user removes the seal 334 (not shown) from the lip 364 of the housing 321. The flavor applicator 320 is placed onto the drinking end of a bottle wherein the drinking end of the bottle extends through the opening 322 of the housing 321 and through the opening 362 of the filter 346. Inversion of the flavor applicator 320 causes flavoring from the reservoir 349 to pass through the stop plate apertures 359 of the stop plate 345, through the filter 346, and onto the drinking end of the bottle that is within the flavor applicator 320. Flavoring contained within the filter 346 also contacts, and transfers to, the drinking end of the bottle.

Those skilled in the art understand that the flavor applicator, as described, can be modified to work with various sized drinkware.

I claim:

1. A flavor applicator comprising:

a housing, an internal reservoir comprising flavoring, a stop plate, a filter, and a seal;

wherein the housing has a first end, a second end and an opening coplanar with the first end;

wherein a first pillar is integral with said second end of the housing and extends through the housing towards the first end of the housing;

wherein a second pillar is integral with the first pillar and extends towards the first end of the housing;

wherein an exterior diameter of the second pillar is smaller than an exterior diameter of the first pillar forming an annular shelf between the two pillars;

wherein the stop plate rests on said annular shelf and is attached to the annular shelf via an adhesive;

wherein the stop plate comprises a plurality of apertures;

wherein the filter rests on said stop plate and is attached to an interior of the housing via an adhesive;

wherein the seal covers the opening of the housing.

2. The flavor applicator of claim 1 wherein the exterior diameter of the first pillar is smaller than an inner diameter of the housing forming the internal reservoir between an interior wall of the housing and the first pillar.

3. The flavor applicator of claim 1 wherein flavoring is also stored in the filter.

4. A method for applying flavor to drinkware comprising:

providing the flavor applicator as recited in claim 1;

removing the seal of the flavor applicator;

placing the unsealed flavor applicator over a drinking end of a bottle so that the drinking end of the bottle extends through the opening of the housing; and wherein said flavor applicator causes the flavoring to transfer from the internal reservoir to the drinking end of the bottle.

* * * * *